United States Patent [19]

Geiser

[11] 4,002,259

[45] Jan. 11, 1977

[54] SAFETY CLOSURE

[75] Inventor: Milton L. Geiser, Millersville, Pa.

[73] Assignee: Kerr Glass Manufacturing Corporation, Los Angeles, Calif.

[22] Filed: Oct. 6, 1975

[21] Appl. No.: 620,221

[52] U.S. Cl. ..... 215/216; 215/221

[51] Int. Cl.[2] ..... B65D 55/02; B65D 55/56; A61J 1/00

[58] Field of Search ..... 215/9, 216, 221; 222/153

[56] References Cited

UNITED STATES PATENTS

| | | | |
|---|---|---|---|
| 3,891,110 | 6/1975 | Gach | 215/216 |
| 3,894,647 | 7/1975 | Montgomery | 215/216 |

*Primary Examiner*—George T. Hall
*Attorney, Agent, or Firm*—Fitch, Even, Tabin & Luedeka

[57] ABSTRACT

To prevent leakage of the container contents when a child attempts to turn a child-safe closure in the removal direction, the closure is formed with a series of closely spaced detent members at least one of which will abut a detent member on the container to limit turning of the closure in the removal direction to a degree insufficient to allow leakage. Preferably, a series of six closely adjacent radially extending tab like detent members extend outwardly from the skirt wall of the closure within a quadrant of the skirt wall to assure locking by at least the leading or trailing one of the detent members under the worst tolerance conditions. The intermediate detent members become effective for other tolerance conditions which result in the manufacture of the closure and container which are usually made of molded plastic. A simultaneous manual deflection of the closure detent members from their paths of travel for abutting the container detent member and turning of the closure in the removal direction allows the closure to be removed from the container.

9 Claims, 6 Drawing Figures

SAFETY CLOSURE

This invention relates to a safety closure which can be readily removed by adults from a container, but which is relatively safe from removal by children; and more particularly to a child-proof safety closure which maintains a substantially leakproof seal with the container if a child attempts to remove the same.

Safety closures for containers have been proposed, for packaging toxic materials which may be harmful to children particularly when ingested, with a detent member on the closure for interlocking with a cooperating detent member on the container blocking removal of the closure by children but allowing adults who can purposefully deflect the detent member to remove the closure and gain access to the container contents. For instance, a closure has been disclosed with a detent member projecting radially from the skirt wall of the closure for abutting an upwardly projecting detent member molded on the neck of the container. A child turning the closure in the opening direction, after the closure has been turned to its fully sealed and closed position, will cause the detent members to abut and this blocks further unscrewing of the closure. Such a closure may be adequate when there is no need for a tight seal for the contents of the container, such as for certain solid materials; but this type of closure does not provide assurance of a liquid tight seal when the child turns the closure in the removal direction to abut the detent members. This is because tolerance accumulations resulting from the molding of the closures from plastic and in the manufacture of the container are so great that the degree of turning of the closure to a fully closed condition varies significantly from one instance to the next. For instance, when combining plastic molded closures and containers, as described herein, it has been found that approximately 90° of turning movement occurs between the minimum and maximum tolerance accumulations. A 90° turning movement of the closure to abut detent members may prevent closure removal by children, but it will allow leakage and children access to the leaked material.

It has been proposed to provide a plurality of ratchet teeth on the lower rim of the closure skirt wall for cooperation with a plurality of ratchet teeth on the container to maintain a tighter seal in a child safe closure and container combination. In one proposal of this type, ratchet teeth are formed on a very flexible wall on the container and this flexible wall may be deflected to lower the ratchet thereon from the ratchet teeth on the closure allowing turning and removal of the closure. For a number of reasons, manufacturers have not adopted a container having a flexible shoulder wall with ratchet teeth thereon. Another proposal has been to form a closure with a pair of skirt walls joined by a flexible web which acts as a hinge allowing the outer one of the skirt walls to be shifted vertically to lift ratchet teeth on its lower rim above ratchet teeth on the container shoulder. Such closures are relatively massive requiring a considerable amount of plastic for their manufacture and appear to require a substantial upward vertical force for disengagement. Also, the operation of such closures is not readily apparent to the ultimate user; and the frustrations or failure to instantly comprehend the manner of removal may be transferred by the user to the maker of the package contents. Also, it has been proposed to provide a plurality of tabs on a closure wall for cooperation with a plurality of upstanding teeth formed on a shoulder of a container.

The locking of the closure at its closed position is also useful in preventing spillage of the material during handling of a container because the positive lock cannot be vibrated loose and gone unnoticed as with some conventional closures. Thus, there is a need for an improved single piece closure which is inexpensive to manufacture and the operation of which can be readily comprehended upon observation thereof and yet which provides a relatively leakproof seal over a wide range of manufacturing tolerances.

Accordingly, a general object of the invention is to provide a new and improved safety closure which obviates many of the disadvantages above-described for prior closures.

Another object of the invention is to provide a closure and container combination which will maintain a substantially leakproof seal between the closure and the container even though a child tries to turn the closure in the removal direction.

Other objects and advantages of the present invention will become apparent from the following detailed description taken in connection with the accompanying drawings in which.

Figure 4:
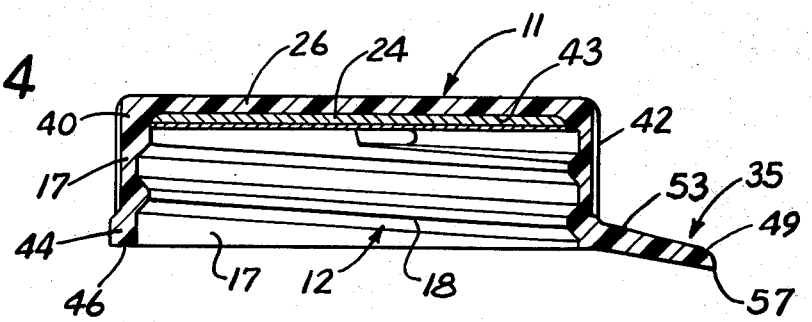
FIG. 4 is an enlarged sectional view of the closure shown in FIG. 1.
Figure 5:
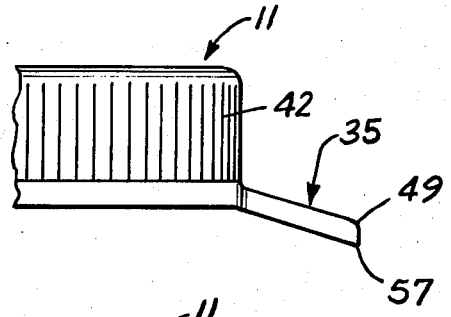
FIG. 5 is a fragmentary front elevational view of the closure.

As shown in the drawings for purposes of illustration, the invention is embodied in a safety closure 11 having a container fastening means 12 for attaching the closure to a container 16 to cover an open mouth 15 for the container. Preferably, the fastening means 12 is in the form of an internal spiral screw thread 18, as best seen in FIG. 4, formed on an inner side of a skirt wall 17 of the closure for cooperation with an external screw thread 20 formed on a neck 21 of the container 16. For enhancing the tightness of the seal to leakage, particularly of liquid contents in the container, a compressible liner 24 may be provided in the closure disposed against the inner side of the top wall 26 of a closure for engagement with the rim 28 of the container mouth 15. Cooperating detent means are formed on the closure 11 and the container 16 to prevent unscrewing of the closure unless one of the detent means is displaced simultaneously with the unscrewing of the closure.

The closure 11 is made of molded plastic and is subject to manufacturing tolerances as is the container, which in this illustrated embodiment of the invention is also made of molded plastic but may be made of glass or other materials. Additionally, when a liner 24 is used it also may vary slightly in thickness and, after repetitive closures, the liner may take a permanent compressive set reducing its thickness. While each of the components described may fall within the permissible minimum and maximum tolerance deviation for acceptable closures and containers, these tolerances may culminate and result in a closure which has to be turned significantly to a greater or lesser degree than other closures which are precisely dimensioned in order to effect the fluid tight seal. Despite efforts to maintain close tolerances for each of the components including the closure 11, the container 16 and liner 24, it has been found that with these tolerance conditions and with repetitive tightening of the closure to its fully closed position, that the closures will differ in about one quadrant of a rotation in order to be fully sealed. Thus, it is not possible to locate a single detent member on the container and on the closure, as has been suggested, to maintain a fluid tight seal because an extensive unscrewing or backing off of a closure spaces the liner from the container rim allowing leakage of the liquid contents of the container if it is inverted.

In accordance with the present invention, an inexpensive, easy to operate closure 11 provides and maintains a sealed condition with the container 16 even though a child attempts to turn the closure in the removal direction. This is achieved by forming a series of closely adjacent, individually manipulatable detent members 35 on the closure 11 each of which may have a blocking or locking engagement with a single detent member 36 on the container 16 depending upon the tolerance accumulations for the individual closure and container combination. In the illustrated embodiment of the invention, a series of individually manipulatable detent members 35*a*, 35*b*, 35*c*, 35*d*, 35*e* and 35*f* covers approximately a quadrant of the closure circumference with each of the detents becoming operable for blocking engagement after each 13° of closure movement.

In applying each of the closures to its fully closed position, the leading closure detent member 35*a* will always be deflected by the container detent member 36 as it passes the latter during the final turning movement of the closure; and depending upon the tolerance condition one or more of the following five detent members 35*b*, 35*c*, 35*d*, 35*e* or 35*f* may also be flexed and deflected by the detent member of the container. When removing the closure, it is necessary to lift all of the closure detent members having traveled past the container detent 36 initially before the closure may be freely turned in the removal direction. Usually, an adult may lift simultaneously a pair of detent members 35 so that if more than two detent members have been passed by, it will require at least two lifting manipulations of the detent members by the adult before the closure can be freely unscrewed. Thus, the cap will be held in its locked position and will require a cognizable and deliberate manipulation by the user before the closure can be removed.

Referring now to the closure 11 in greater detail, it is preferably formed of a molded plastic material formed in one piece (except for the separate liner 24) from a plastic such as polypropylene. The illustrated closure is formed with a circular planar top wall 26 which is integrally joined at an outer circumferential corner to and with the depending skirt wall 17 which has the internal screw thread 18 integrally molded on the interior surface of the skirt wall. The screw thread 18 extends from a lower end adjacent a lower rim wall 46 on the skirt to an upper end 40 which defines a small cavity with inner surface 43 of the closure top wall 26 within which cavity is disposed the liner 24. The liner may be one of several conventional designs and materials and hence is not described in detail herein.

Preferably, the outer side of the closure skirt wall is fluted or formed with vertically extending flutes or ribs 42 to facilitate the gripping and turning of the closure 11 by applying a turning torque thereto. The closure skirt wall is thickened at its rim portion 44 and the lower edge or rim wall 46 of this rim portion is located at a predetermined distance from the inner side 43 of the top wall 26 by a distance typically referred to as the "H" dimension.

In this instance, the detent members 35 are located at and attached to the closure rim portion 44 at a location adjacent the lower end of the screw thread 18; and as will be appreciated the detent members travel downwardly toward a wall 48 on the container as well as turning rotatively about the container neck 21. For the purpose of providing sufficient strength to withstand multiple bending operations without breaking, snapping or exceeding the elastic limit of the plastic, it is preferred that each of the detent members 35 be molded with a thicker cross-sectional portion at their respective junctures with the skirt wall 17 than at their outer free ends 49. The latter provide a convenient means for applying a lifting force to the detent members located adjacent the detent projection 36 on the container 16. The preferred cross-sectional thickness variation is substantially uniform along the length of each detent member and results in a longer and gentler bending of the detent member along its length in contrast to a sharply curved bend at its juncture with the skirt wall.

In this instance, each of the detent members 35 is identical in its radial extent outwardly from the central axis from the closure and each is formed with an identical circumferential arcuate extent, such as, for example 13°. Also, it is preferred that the spacing between the adjacent detent members be only several degrees, such as, for example 2°, with an equal space being present between each of the adjacent detent members 35*a*–35*f*.

Figure 6:
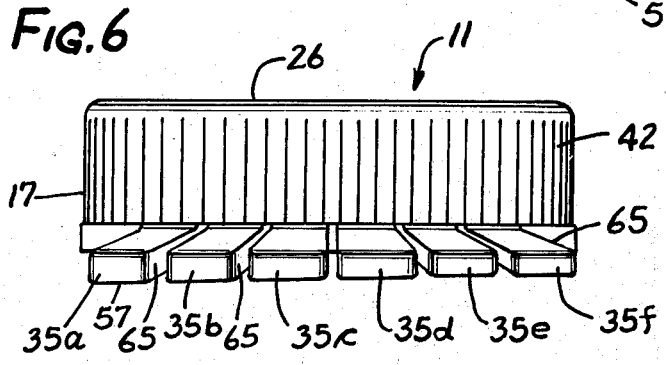
FIG. 6 is a side elevational view of the closure.

Because the spiral screw thread 18 causes each of the detent members 35 to partake of an upward travel as they rotate in the removal direction, it is preferred that the leading one or ones of the detent members project further downwardly to assure that leading detent members 35*a* and 35*b* will abut the container detent member 36 even though they have traveled upwardly during their initial travel from their locations at the fully closed position for the closure. By way of example, the leading detent member 35*a* extends downwardly a distance of 0.101 inch below the closure skirt rim 46 whereas the trailing detent member 35*f* extends downwardly a distance of 0.060 inch below the closure skirt rim 46. The intermediate ones of detent members may be progressively spaced in a downward direction between these end ones of the detent members. The preferred manner of achieving this greater downward extent for the leading detent members 35*a* and 35*b* is by making these tabs thicker in downward direction than the trailing tabs 35*c* and 35*f* as shown in FIG. 6.

In the preferred embodiment of the invention, the top surface 53 of each detent member is inclined at an angle of about 13° to a horizontal plane. The lower sides 55 of the respective detent tabs 35 are at various angles between an angle of almost 15° for the leading tab 35*a* to about 9° for the trailing detent member 35*e*. In this embodiment of the invention, the outer free ends 49 of the detent members are formed with a slight radius on their top edges whereas the lower edges are pointed at sharper edge 57. It is thought that the sharper edge and the requirement of about 4 to 5 pounds of upwardly lifting force for each detent member 35 will discourage children from attempting to deflect them upwardly while simultaneously turning the closure in the removal direction to clear the container detent member 36.

Figure 1:
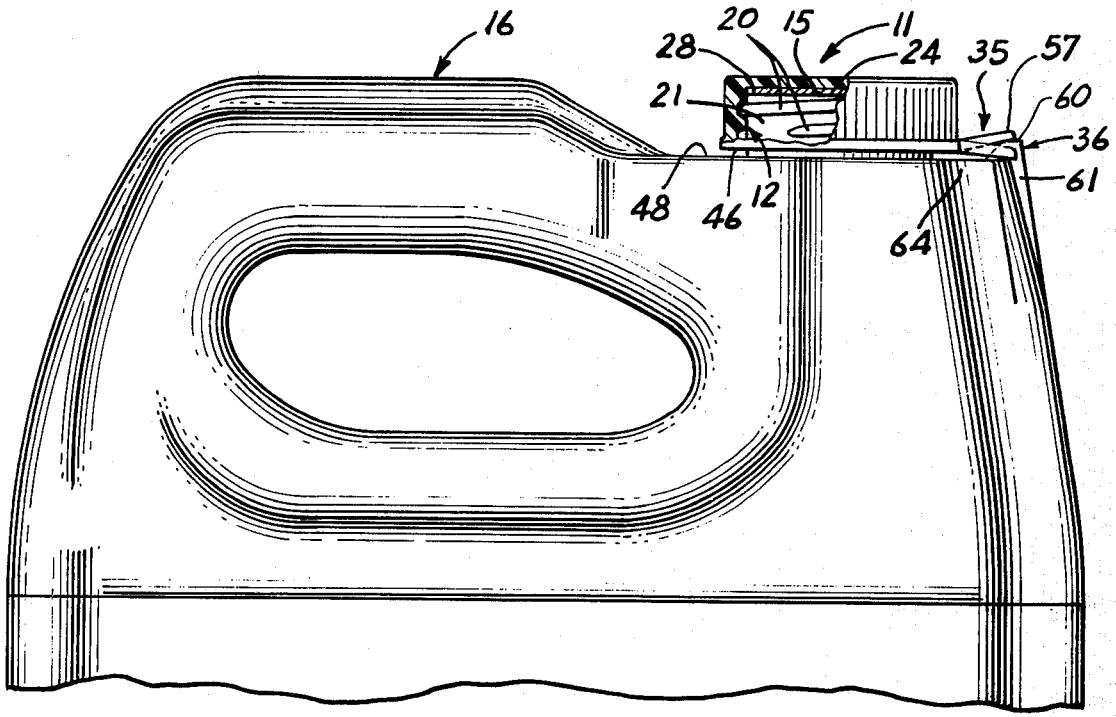
FIG. 1 is a front elevational view of a container and closure embodying the novel features of the invention.
Figure 2:
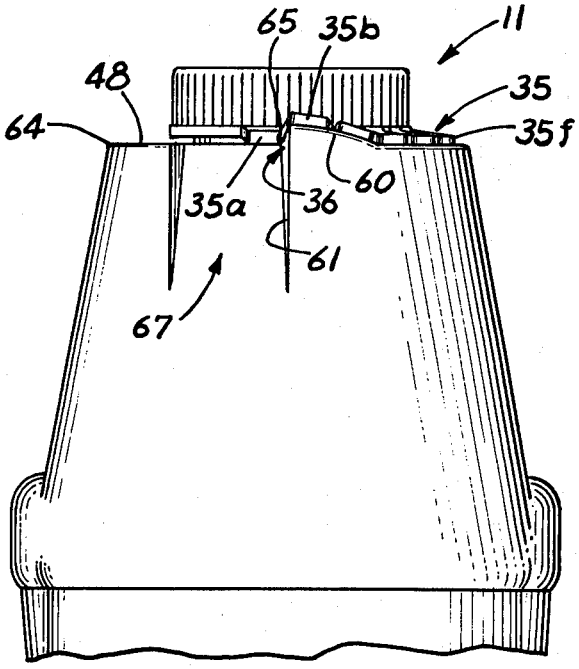
FIG. 2 is a side view of the container and closure shown in FIG. 1.
Figure 3:
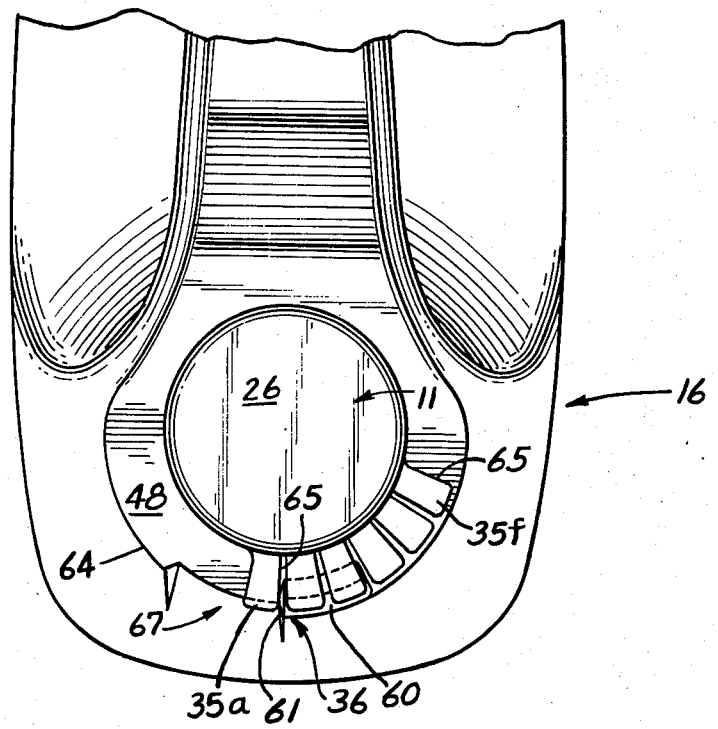
FIG. 3 is a plan view of the container and closure shown in FIG. 1.

The container detent member 36 is preferably in the form of a single upstanding projection having an upwardly sloped camming surface 60 integral with the top shoulder wall 48 of the container. As best seen in FIG. 1, this camming surface 60 is located at an outer peripheral edge 64 of the shoulder wall 48 and acts to cam upwardly the outer ends 49 of the closure detent members 35 coming in contact with this camming surface. As the closure detent members 35 slide over the camming surface 60, they travel past a vertical abutment wall 61 and then snap downwardly to a position spaced slightly upwardly to the container shoulder wall 48, as seen in FIG. 1, with these detent members 35 no longer being stressed and deflected. Because of the small spacing between adjacent ones of the detent members 35, usually one or more of the detent members remain on the inclined camming surface 60, as shown in FIGS. 1 and 2, when the closure 11 is in its fully closed position, except for the instance when the closure is turned sufficiently that the trailing detent member **36*f* passes the abutment wall 61 and is in position to limit the turning movement of the closure in the reverse direction. Irrespective of which one of the detent members has its abutment wall 65 most closely adjacent the abutment wall 61, the maximum turning movement of the closure from its fully closed condition to abutment will not exceed 15° which has been found satisfactory to maintain a seal between the liner 24 and the top rim 28 of the container 16. Usually, the compressed liner 24 is able to expand slightly and continue to fill the gap between the liner 24 and the rim 28 when the closure is turned to abut its abutment wall 65 with container abutment wall 61**; or the gap created with the unscrewing is too small to allow a significant amount of leakage even if the closure is turned a full 15° from the fully closed position.

Preferably, the closure detent members 35 are located closely adjacent a portion of the container 16 to be protected against snagging or otherwise being obtrusive. In this instance, the outer free ends 57 of the detent members **35*a*–35*f* do not project outwardly of the edge 64 of the container shoulder wall 48 except when positioned at an access groove or dent 67 formed in the neck 21 of the container. Herein, the access groove is sufficiently wide to allow an adult's finger to engage two adjacent closure detent members 35 simultaneously and to lift them both upwardly sufficiently to pass the top edge of the abutment wall 61** as the closure is turned simultaneously with the lifting.

It will be appreciated that the illustrated configurations of the detent members 35 or 36 may be changed appreciably from that illustrated herein and still provide the claimed locking by selected ones of a plurality of individually operable detent members on the closure becoming effective depending on the degree of final turning movement. Preferably, each of the detent members is separately actuatable but means could connect several of them together for simultaneous individual actuation.

From the foregoing, it will be seen that the present invention provides a simple and inexpensive closure of a childsafe kind which allows tightening of the closure to the fully closed or sealed position and which may permit a small back-off or turning of the closure by a child which is insufficient to permit substantial leakage of the container contents. A closure may be inexpensively formed with a series of radially extending detent members extending through approximately a quadrant of a turn affording a high degree of flexibility for locking with a single detent on a container despite various tolerances accumulating during manufacture of the closure or of the container. Such a locking and sealing system will maintain within limits a sealed condition despite a reduced cross-sectional thickness of the liner caused by a depression set of the lining material after several usages of the closure.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A container and a closure comprising, in combination, a fastening means on the container, a fastening means on the closure for securing the closure to the container and for bringing portions thereof into closed and sealed engagement with said container to prevent leakage of the container contents, a single detent member on said container, a series of individual detent members formed on the said closure closely adjacent each other in a circumferential direction each for individual abutment with said container detent member, said detent members on said closure having a limited arcuate extent and each adapted for deflection by the cooperating detent member on said container when the closure is being secured, the degree of turning of the closure required to effect the closed and sealed engagement of the closure with the container determining which of said closure detent members have been deflected, an abutment wall on each of said closure detent members positioned for abutting said single container detent member after having been deflected thereby to lock said closure against removal, said abutment walls being spaced by about 15° from each other, said detent members being spaced by gaps of several degrees extending between adjacent walls of adjacent detent members, and means on said closure detent members for permitting individual manual manipulation thereof to allow displacement of the closure detent members to positions to move their abutment walls past the container detent member when the closure is turned in the removal direction.

2. A combination in accordance with claim 1 in which approximately six tabs are disposed within approximately one quadrant of said skirt wall and project radially outwardly from said skirt wall.

3. A combination in accordance with claim 1 in which a substantially horizontal shoulder wall is formed on said container, said container detent member being the only upstanding projection on said shoulder wall.

4. A combination in accordance with claim 3 in which an access groove is formed in said shoulder wall of said container exposing said means for manual manipulation of said detent members aligned with said access groove.

5. A closure for securing to a container comprising a plastic body, a top wall on said body, an integral skirt wall attached to the peripheral edge of said top wall, screw thread fastening means formed on said body closure for engagement with cooperating screw thread means on a container to lower the closure with the turning thereof to tighten and fasten said closure to said container, a series of detent members in the form of flat tabs attached at inner ends to said skirt wall for cooperation with a detent member on the container, said tabs projecting substantially radially outwardly of said closure skirt walls and being spaced circumferentially from each other for separate and individual cooperation with detent means on the container depending on the extent of turning of the closure onto the container to bring the closure to the fully closed position, the leading tabs in the direction of fastening extending downwardly a greater distance than the following tabs to assist abutment of the leading tabs with the detent members on the container, said closure tabs being flexible and displaceable by manual pressure thereon to allow turning of the closure in the release direction and removal of said closure from said container.

6. A closure in accordance with claim 5 in which a series of six detent members are disposed within approximately one quadrant of said skirt wall.

7. A closure in accordance with claim 5 in which said detent members are formed of decreasing cross-sectional thickness from said leading one to said trailing one of said detent members.

8. A combination in accordance with claim 1 in which the leading one of the individual detent members extends downwardly to a greater extent than the succeeding detent members thereby reducing the height needed for said single detent member on said container.

9. A closure for securing to a container comprising a screw thread fastening means on the closure for securing the closure to the container and for bringing portions thereof into closed and sealed engagement with said container to prevent leakage of the container contents, a series of individual detent members formed on the said closure closely adjacent each other in a circumferential direction each for individual abutment with a detent member on a container member, said detent members on said closure having a limited arcuate extent and each adapted for deflection by the cooperating detent member on said container when the closure is being secured, the degree of turning of the closure required to effect the closed and sealed engagement of the closure with the container determining which of said closure detent members have been deflected, an abutment wall on each of said closure detent members positioned for abutting the container detent member after having been deflected thereby to lock said closure against removal, said abutment walls being spaced by about 15° from each other, said detent members being spaced by gaps of several degrees extending between adjacent walls of adjacent detent members, and means on said closure detent members for permitting individual manual manipulation thereof to allow displacement of the closure detent members to positions to move their abutment walls past the container detent member when the closure is turned in the removal direction.

* * * * *

UNITED STATES PATENT AND TRADEMARK OFFICE

CERTIFICATE OF CORRECTION

PATENT NO. : 4,002,259

DATED : January 11, 1977

INVENTOR(S) : Milton L. Geiser

It is certified that error appears in the above-identified patent and that said Letters Patent are hereby corrected as shown below:

Column 6, Claim 2, line 50, "tabs" should read --closure detent members--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*